US007079796B2

(12) United States Patent
Sato

(10) Patent No.: US 7,079,796 B2
(45) Date of Patent: Jul. 18, 2006

(54) COLOR IMAGE FORMING APPARATUS WITH TONER RECYCLING MECHANISM

(75) Inventor: Masumi Sato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/361,581

(22) Filed: Feb. 11, 2003

(65) Prior Publication Data

US 2003/0198491 A1 Oct. 23, 2003

(30) Foreign Application Priority Data

Feb. 12, 2002 (JP) ..... 2002-034036

(51) Int. Cl.
*G03G 15/16* (2006.01)

(52) U.S. Cl. ..... 399/297; 399/299; 399/359

(58) Field of Classification Search ..... 399/297, 399/299, 359, 358, 360, 302, 308
See application file for complete search history.

(56) References Cited

U.S. PATENT DOCUMENTS

| | | | |
|---|---|---|---|
| 6,088,551 | A | 7/2000 | Satoh et al. |
| 6,104,419 | A | 8/2000 | Sato |
| 6,263,175 | B1 | 7/2001 | Sawada et al. |
| 6,334,039 | B1 | 12/2001 | Yoshinaga et al. |
| 6,360,065 | B1 | 3/2002 | Ishibashi et al. |
| 6,366,754 | B1 | 4/2002 | Sato et al. |
| 6,393,241 | B1 | 5/2002 | Matsumoto et al. |
| 6,416,176 | B1 | 7/2002 | Yasu et al. |
| 6,470,161 | B1 | 10/2002 | Fujishiro et al. |
| 6,501,913 | B1 | 12/2002 | Hattori et al. |
| 6,505,022 | B1 | 1/2003 | Kosuge et al. |
| 6,507,354 | B1 | 1/2003 | Sato |
| 6,507,720 | B1 | 1/2003 | Kabumoto et al. |
| 6,519,428 | B1 | 2/2003 | Ohtoshi et al. |
| 6,546,219 | B1 | 4/2003 | Sato et al. |
| 2001/0022905 | A1 * | 9/2001 | Kosuge et al. ..... 399/359 |

FOREIGN PATENT DOCUMENTS

| | | | |
|---|---|---|---|
| JP | 11149216 | A * | 6/1999 |
| JP | 2002-91123 | | 3/2002 |
| JP | 2002-174934 | | 6/2002 |

OTHER PUBLICATIONS

U.S. Appl. No. 10/660,571, filed on Sep. 12, 2003, Noguchi et al.
U.S. Appl. No. 10/726,665, filed Dec. 4, 2003, Hattori.
U.S. Appl. No. 10/921,933, filed Aug. 20, 2004, Sato.

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A color image forming apparatus of the present invention includes a belt for sequentially transferring toner images of different colors to a sheet one above the other. A plurality of image forming units face the belt, and each includes an image carrier and a developing device and a cleaning device arranged around the image carrier. The belt is inclined such that one of opposite runs thereof adjoining the image forming units has opposite ends positioned at different levels from each other. The cleaning device of each image forming units is positioned at a higher level than the developing device.

4 Claims, 4 Drawing Sheets

COLOR IMAGE FORMING APPARATUS WITH TONER RECYCLING MECHANISM

BACKGROUND OF THE INVENTION

1. Field of the Invention

The present invention relates to a color printer, color copier, color facsimile apparatus or similar color image forming apparatus.

2. Description of the Background Art

Conventional color image forming apparatuses include a tandem, color image forming apparatus including a single photoconductive element or image carrier and, e.g., four image forming units each being included in a particular developing device. Four toner images, e.g., yellow, magenta, cyan and black toner images are sequentially transferred from the photoconductive element to a sheet or recording medium being conveyed by a belt or an intermediate image transfer belt one above the other, completing a full-color image on the sheet. Because the image forming units are configured independently of each other, toners of different colors collected by respective cleaning devices are not mixed together and can therefore be recycled.

To recycle each collected toner, i.e., return it from the cleaning device to the developing device, a device for conveying the collected toner from the former to the latter is essential. While this recycling device is, in many cases, implemented as a coil, screw or similar mechanical conveying device, the mechanical device has the following problem left unsolved.

Even if the developing device and cleaning device are positioned at substantially the same level or height, the collected toner must be conveyed from the lower portion of the cleaning device to the upper portion of the developing device against gravity. As a result, the mechanical conveying device exerts undesirable stress on the toner during conveyance, bringing about, e.g., cohesion of the toner that lowers image quality. Particularly, color toner is more susceptible to stress than black toner and, in many cases, discarded without being recycled due to, e.g., frequent cohesion.

Technologies relating to the present invention are disclosed in, e.g., Japanese Patent Laid-Open Publication Nos. 2002-91123 and 2002-174934.

SUMMARY OF THE INVENTION

It is an object of the present invention to provide a color image forming apparatus allowing toner to be desirably recycled by reducing stress to act on collected toner.

A color image forming apparatus of the present invention includes a belt for sequentially transferring toner images of different colors to a sheet one above the other. A plurality of image forming units face the belt, and each includes an image carrier and a developing device and a cleaning device arranged around the image carrier. The belt is inclined such that one of opposite runs thereof adjoining the image forming units has opposite ends positioned at different levels from each other. The cleaning device of each image forming units is positioned at a higher level than the developing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
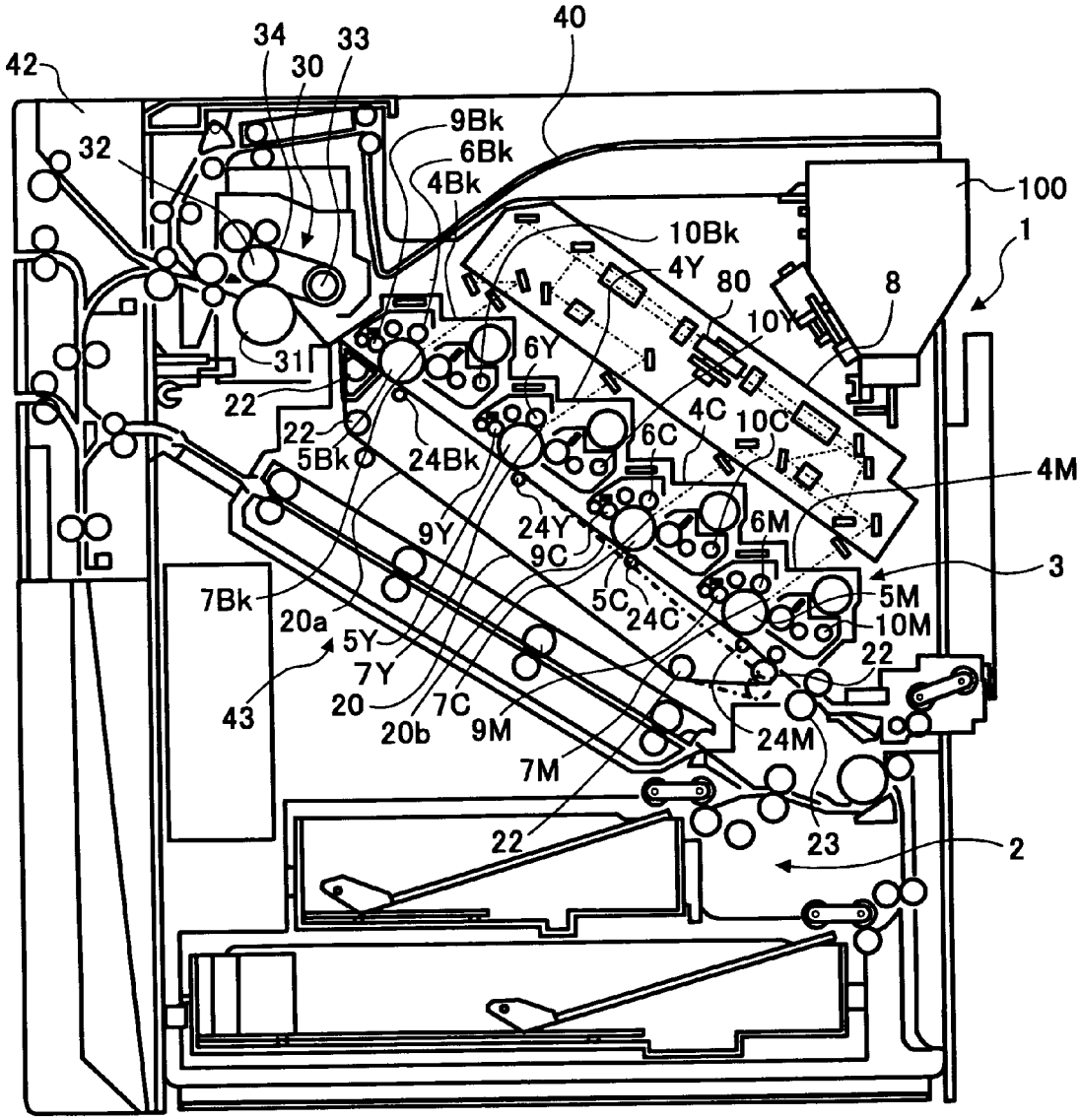
FIG. 1 is a view showing the general construction of a color image forming apparatus embodying the present invention.

Referring to FIG. 1 of the drawings, a color image forming apparatus embodying the present invention is shown and implemented as a color laser printer by way of example. As shown, the color laser printer, generally 1, includes a sheet feeding section 2 arranged in a bottom portion and an image forming section 3 positioned above the sheet feeding section 2. The image forming section 3 includes a belt unit 20 inclined such that its sheet inlet side is positioned at a lower level than its sheet outlet side. In the belt unit 20, an endless belt 20*a* is passed over a plurality of (four in the illustrative embodiment) rollers 22. A magenta, a cyan, a yellow and a black image forming unit 4M, 4C, 4Y and 4Bk are sequentially arranged in this order along the upper run 20*b* of the belt 20*a*; the image forming units 4M and 4Bk are positioned at the lowest level and the highest level, respectively.

Because the image forming units 4M through 4Bk are identical in configuration, their structural elements are simply distinguished from each other by suffixes M through Bk. The image forming unit 4M is shown in FIG. 2 in an enlarged view by way of example.

Figure 2:
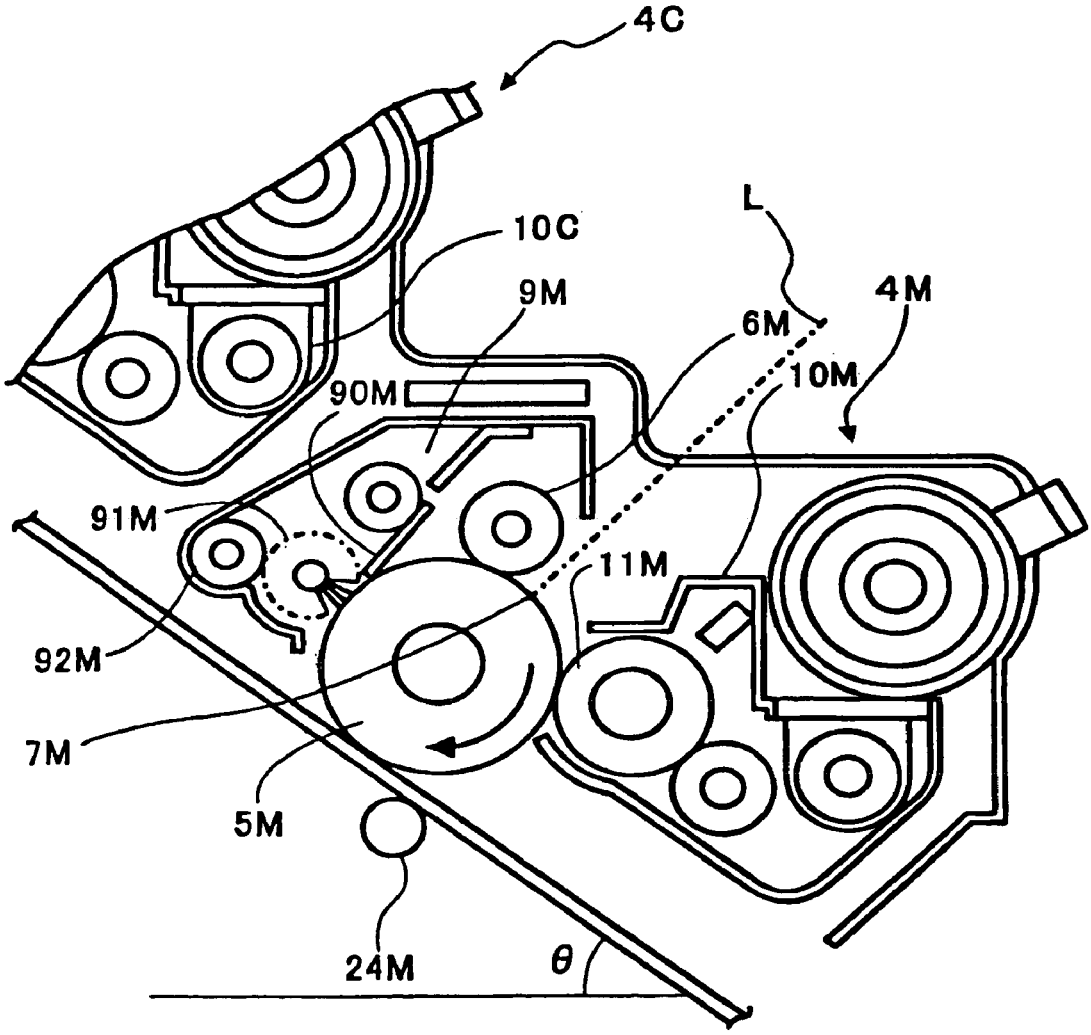
FIG. 2 is an enlarged view showing part of image forming units included in the illustrative embodiment.

As shown in FIGS. 1 and 2, the image forming units 4M through 4Bk include photoconductive drums or image carriers 5M through 5Bk, respectively. Drive means, not shown, causes each of the drums 5M through 5Bk to rotate clockwise, as viewed in FIGS. 1 and 2. Arranged around the drums 5M through 5Bk are charge rollers or charging means 6M through 6Bk, optical writing positions 7M through 7Bk, developing devices or developing means 10M through 10Bk, and cleaning devices or cleaning means 9M through 9Bk, respectively. An optical writing unit 8 scans the drums 5M through 5Bk with laser beams via the optical writing positions 7M through 7Bk, respectively. The developing devices 10M through 10Bk each store a two-ingredient type developer made up of toner of a particular color and carrier. A toner replenishing device, which will be described later, replenishes fresh toner to each of the developing devices 10M through 10Bk, as needed.

A full-color mode operation available with the color laser printer 1 will be described hereinafter. The charge roller 6M uniformly charges the surface of the drum 5M. In the optical writing unit 8, a laser beam issuing from a laser diode, not shown, is steered by a polygonal mirror 80 and then propagated through a cylinder lens and other optical devices to scan the charged surface of the drum 5M. As a result, a latent image to be developed by magenta toner is formed on the drum 5M in accordance with image data received from a personal computer or similar host machine. The developing device 10M develops the latent image with magenta toner to thereby produce a magenta toner image.

In the illustrative embodiment, laser beams reflected by a single polygonal mirror each are incident on the surface of particular one of the drums 5M through 5Bk. The optical writing unit is incline substantially parallel to the belt 20*a*, so that the optical paths to the drums 5M through 5Bk can be easily provided with the same length.

A sheet is fed from the sheet feeding section 2 and then stopped by the nip of a registration roller pair 23, which is positioned upstream of the belt 20*a* in the direction of sheet conveyance. Subsequently, the registration roller pair 23 conveys the sheet toward the belt 20*a* such that the leading edge of the sheet meets the leading edge of the magenta toner image carried on the drum 5M. When the sheet is conveyed by the belt 20*a* to an image transfer position where the belt 20*a* faces the drum 5M, an image transfer roller 24M, facing the inner surface of the belt 20*a*, transfers the magenta toner image from the drum 5M to the sheet.

In the other image forming units 4C, 4Y and 4Bk, a cyan toner image, a yellow toner image and a black toner image are respectively formed on the drums 5C, 5Y and 5Bk in the same manner as the magenta toner image. The cyan, yellow and black toner images are sequentially transferred from the drums 5C, 5Y and 5Bk to the sheet being conveyed by the belt 20*a* over the magenta toner image by respective image transfer rollers 24C, 24Y and 24Bk. As a result, a full-color image is completed on the sheet in substantially the same short period of time as a monochromatic image. The cleaning devices 9M through 9Bk respectively remove the toners left on the drums 5M through 5Bk after the image transfer.

The sheet with the full-color image is separated from the belt 20*a* and then introduced into the fixing device 30. In the illustrative embodiment, the fixing device 30 includes a rigid press roller 31, a relatively soft fixing roller 32 formed of, e.g., sponge and pressed against the press roller 31, and a belt 34 passed over the fixing roller 32 and a heat roller 33 positioned upstream of the fixing roller 32 in the direction of sheet conveyance. The belt type fixing device 30 is advantageous over a roller type fixing device in that, e.g., it reduces warm-up time.

The sheet coming out of the fixing device 30 is driven out of the printer to a print tray 40 face down or steered, in a duplex print mode, toward a turning unit 42. The face-down discharge of the sheet is substantially essential with a printer for stacking prints in order of page. In the duplex print mode, the turning device 42 turns the sheet and then delivers it to a duplex conveyance path 43, which is positioned below the belt 20*a* and inclined substantially parallel to the belt 20*a*. By so inclining the duplex conveyance path 43, it is possible to reduce the distance of conveyance and to pull out the sheet together with the belt 20*a* in the event of a jam. The sheet passed through the duplex conveyance path is again conveyed by the belt 20*a* via the image forming units 4M through 4Bk, so that another full-color image is formed on the reverse surface of the sheet. The resulting duplex print is also driven out to the print tray 40.

As stated above, the duplex conveyance path 43 inclined substantially parallel to the belt 20*a* makes the distance over which the sheet comes out of the fixing device 30 and then turned to be returned to the registration roller pair 23 shortest. Should the duplex conveyance path 43 be horizontal, it would adjoin the top of an upper sheet cassette included in the sheet feeding section 2 and would therefore make it necessary to convey the sheet to such a low level, resulting in a long conveyance path.

In the illustrative embodiment, toner images of different colors are sequentially transferred from the four image forming units 4M through 4Bk to a sheet being conveyed by the belt unit 20 one above the other, as stated above. This type of printer makes the image forming time far shorter than a printer of the type sequentially transferring toner images of different colors from a single image forming unit to an intermediate image transfer body and then transferring the resulting full-color image to a sheet. The upper run 20*b* of the belt 20*a* that adjoins the image forming units 4M through 4Bk is inclined, as stated previously. Therefore, as shown in FIG. 2, nearby image forming units 4M and 4C, for example, are arranged such that the cleaning device 9M and developing device 10C overlap each other in the up-and-down direction. This configuration is shorter in the right-and-left direction than a configuration in which the belt 20*a* is held in the horizontal position.

As shown in FIG. 2, assume that the belt 20*a* is inclined by an angle of θ relative to the horizontal. Then, if the angle θ is excessively small, the developing device 10M and cleaning device 9M cannot be so arranged as to overlap each other in the up-and-down direction. If the angle θ is as great as one close to 90°, some height is required in the up-and-down direction and makes the position of the print tray 40 excessively high although noticeably reducing width in the right-and-left direction. In light of this, the angle θ should preferably be between 35° and 55°. This range of angle θ allows the cleaning device 9M of the image forming unit 4M to be positioned at a higher level than the developing device 10M.

Figure 3:
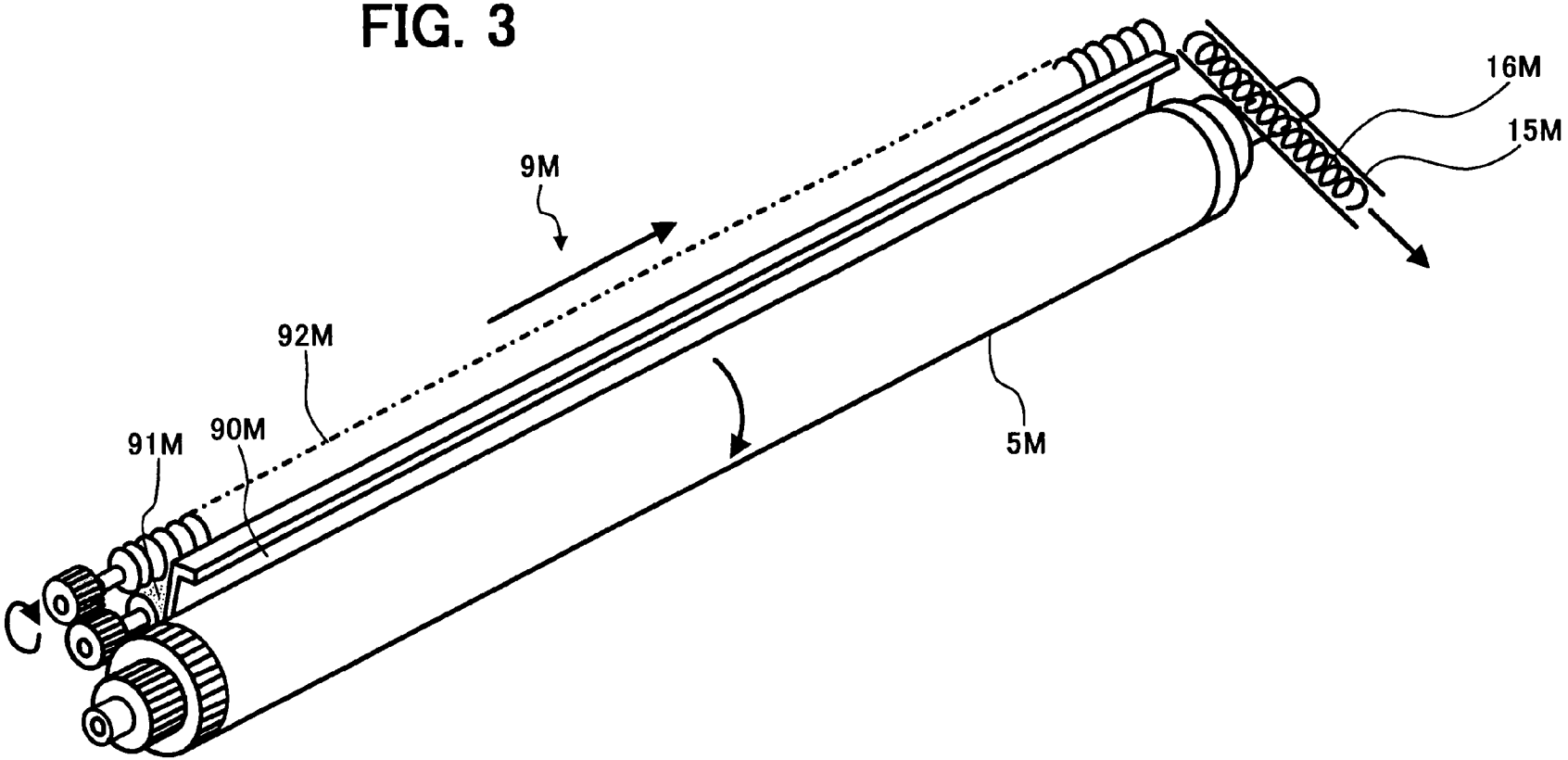
FIG. 3 is an isometric view showing a cleaning device also included in the illustrative embodiment.
Figure 4:
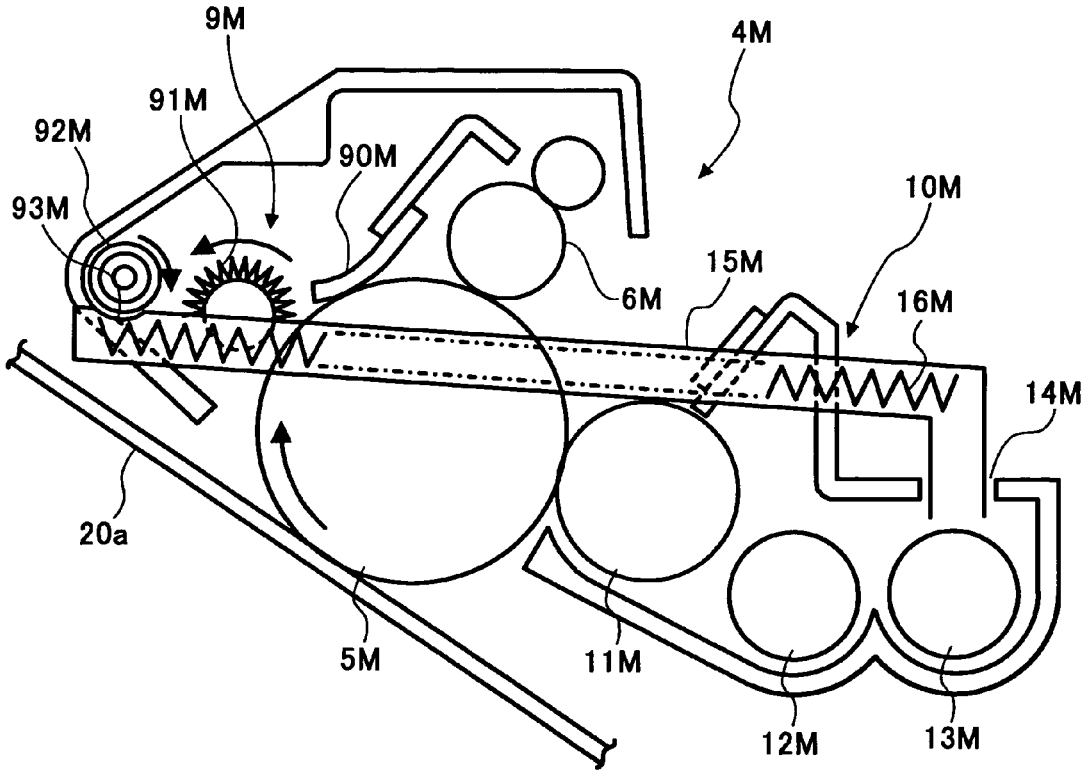
FIG. 4 shows a toner recycling device further included in the illustrative embodiment.

The illustrative embodiment additionally includes toner recycling means for reusing the toners collected by the cleaning devices 9M through 9Bk, as will be described hereinafter. As shown in FIG. 3, the cleaning device 9M of the image forming unit 4M, for example, includes a cleaning blade 90M, a fur brush 91M, and a coil 92M for conveying the toner collected by the cleaning blade 90M and fur brush 91M in the axial direction of the drum 5M. The coil 92M is caused to rotate in a direction indicated by an arrow in FIG. 3, conveying the toner toward the rear of the cleaning device 9M. As shown in FIG. 4, a toner outlet 93M is positioned at the rear end of the cleaning device 9M.

As shown in FIG. 4, the developing device 10M of the image forming unit 4M includes a developing roller 11M facing the drum 5M and a pair of screws 12M and 13M for feeding the developer to the developing roller 11M while agitating it. A toner inlet 14M adjoins the screw 13M for receiving fresh toner replenished to the developing device 10M.

The fresh toner to be replenished to the developing device 10M is stored in a toner container 100 shown in FIG. 1. A powder pump, not shown, delivers the fresh toner from the toner container 100 to the developing device 10M via the toner inlet 14M. The toner inlet 14M is fluidly communicated to the toner outlet 93M of the cleaning device 9M by a recycling tube or path 15M. A coil 16M is received in the recycling tube 15M for conveying the toner collected by the cleaning device 9M to the toner inlet 14M. In this sense, the recycling tube 15M and coil 16M constitute recycling means.

As shown in FIG. 4, the cleaning device 9M is positioned at a higher level than the developing device 10M, so that the recycling tube 15M extends obliquely downward from the cleaning device 9M to the developing device 10M. The toner is therefore smoothly conveyed from the cleaning device 9M to the developing device 10M without counteracting gravity while being subject to a minimum of stress. It is to be noted that stress to act on the toner can be reduced even if the recycling tube 15M extends in substantially the horizontal direction.

Toner recycling means included in the other image forming units 4C, 4Y and 4Bk are identical in configuration and operation with the toner recycling means of the image forming unit 4M and will not be described specifically in order to avoid redundancy.

It is to be noted that the present invention may similarly be implemented as an image forming apparatus of the type using an intermediate image transfer belt if, e.g., the belt 20*a*, FIG. 1, is replaced with the intermediate image transfer belt.

In summary, in accordance with the present invention, a belt unit is inclined such that opposite ends of its upper run, which adjoins a plurality of image forming units, are positioned at different levels or heights. In each image forming unit, cleaning means is positioned above developing means. Toner recycling means, which returns toner collected by the cleaning means to the developing means, forms a recycling path that extends substantially horizontally or has one side adjacent the developing means positioned below the other side. The collected toner can therefore be smoothly conveyed in the direction of gravity while being subject to a minimum of stress. This successfully reduces, e.g., cohesion of the toner ascribable to the stress.

Further, the cleaning means of the lower image forming unit and the developing means of the upper image forming unit next to the lower-image forming unit partly overlap each other in the up-and-down direction. This configuration realizes a compact, color image forming apparatus.

Various modifications will become possible for those skilled in the art after receiving the teachings of the present disclosure without departing from the scope thereof.

What is claimed is:

1. A color image forming apparatus comprising:

means for sequentially transferring toner images of different colors to a recording medium one above the other;

a plurality of image forming units facing said means for sequentially transferring, and each image forming unit comprising an image carrier, means for developing, and means for cleaning arranged around said image carrier; and toner recycling means, including a recycling path, included in at least one of said plurality of image forming units for feeding toner collected by said means for cleaning to a respective said means for developing via the recycling path, the recycling path positioned below said means for cleaning and including a toner outlet below said means for cleaning into which said collected toner is output from said means for cleaning to the recycling path, the recycling path extending from below said means for cleaning and above said means for developing, and the recycling path extending substantially horizontally or having one side adjoining said respective means for developing positioned at a lower level than at said toner outlet;

wherein said means for sequentially transferring is inclined to have opposite ends positioned at different levels from each other, and wherein said means for cleaning of each of said plurality of image forming units is positioned at a higher level than said respective means for developing.

2. The color image forming apparatus as claimed in claim 1, wherein said means for cleaning included in a lower one of said plurality of image forming units and said means for developing included in an upper one of said plurality of image forming units next to said lower one partly overlap each other in an up-and-down direction.

3. A color image forming apparatus comprising:

a belt for sequentially transferring toner images of different colors to a recording medium one above the other;

a plurality of image forming units facing said belt, and each image forming unit comprising an image carrier, a developer, and a cleaning mechanism arranged around said image carrier; and a toner recycling mechanism, including a recycling path, included in at least one of said plurality of image forming units for feeding toner collected by said cleaning mechanism to a respective said developer via the recycling path, the recycling path positioned below said cleaning mechanism and including a toner outlet below said cleaning mechanism into which said collected toner is output from the cleaning mechanism to the recycling path, the recycling path extending from below said cleaning mechanism and above said developer, and the recycling path extending substantially horizontally or having one side adjoining said respective developer positioned at a lower level than at said toner outlet;

wherein said belt is inclined to have opposite ends positioned at different levels from each other, and wherein said cleaning mechanism of each of said plurality of image forming units is positioned at a higher level than said respective developer.

4. The color image forming apparatus as claimed in claim 3, wherein said cleaning mechanism included in a lower one of said plurality of image forming units and said developer included in an upper one of said plurality of image forming units next to said lower one partly overlap each other in an up-and-down direction.

* * * * *